US006241317B1

(12) United States Patent
Wu

(10) Patent No.: US 6,241,317 B1
(45) Date of Patent: Jun. 5, 2001

(54) MODULAR CHAIR CONSTRUCTION

(76) Inventor: Jimmy Wu, 1F, No. 431-1, Sec.6, Chung-Shan N. Rd., Taipei City (TW)

( * ) Notice: Subject to any disclaimer, the term of this patent is extended or adjusted under 35 U.S.C. 154(b) by 0 days.

(21) Appl. No.: 09/456,047

(22) Filed: Dec. 7, 1999

(51) Int. Cl.[7] ..... A47C 7/00

(52) U.S. Cl. ..... 297/440.23; 297/440.1; 297/440.21

(58) Field of Search ..... 297/440.23, 440.1, 297/440.14, 440.15, 440.16, 440.21

(56) References Cited

U.S. PATENT DOCUMENTS

| | | | | |
|---|---|---|---|---|
| 1,278,491 | * | 9/1918 | Metzger | 297/440.23 |
| 1,478,640 | * | 12/1923 | Coverly | 297/411.31 X |
| 2,597,860 | * | 5/1952 | Gerber et al. | 297/440.23 X |
| 2,605,820 | * | 8/1952 | Powellek | 297/440.23 X |
| 2,620,024 | * | 12/1952 | Rietman | 297/440.23 |
| 2,650,656 | * | 9/1953 | Ohlsson | 297/440.23 |
| 2,650,657 | * | 9/1953 | Ohlsson | 297/440.23 |
| 2,678,088 | * | 5/1954 | Jamison, Jr. | 297/440.23 |
| 2,793,685 | * | 5/1957 | Spitz | 297/440.23 X |
| 3,674,311 | * | 7/1972 | Miller | 297/440.23 |
| 3,700,282 | * | 10/1972 | Rowland | 297/440.23 |
| 3,929,375 | * | 12/1975 | Gans | 297/440.23 |
| 3,973,800 | * | 8/1976 | Kogan | 297/440.23 |
| 4,165,902 | * | 8/1979 | Ehrlich | 297/440.23 |
| 4,395,071 | * | 7/1983 | Laird | 297/440.21 |
| 5,080,438 | * | 1/1992 | Moyer | 297/440.23 |
| 5,263,764 | * | 11/1993 | Laughlin et al. | 297/440.23 |
| 5,518,298 | * | 5/1996 | LaPointe et al. | 297/440.1 X |
| 5,529,380 | * | 6/1996 | Blansett | 297/440.23 X |
| 5,551,757 | * | 9/1996 | Glover | 297/440.23 |
| 5,678,897 | * | 10/1997 | Prestia | 297/440.23 X |
| 5,738,414 | * | 4/1998 | Wieland et al. | 297/440.23 X |
| 5,890,767 | * | 4/1999 | Chang | 297/440.23 X |

* cited by examiner

*Primary Examiner*—Peter M. Cuomo
*Assistant Examiner*—Rodney B. White
(74) *Attorney, Agent, or Firm*—Lackenbach Siegel

(57) ABSTRACT

A modular chair includes a seat unit, a back unit that is mounted removably on the seat unit, and two armrest units that are mounted respectively and removably on the left and right sides of the seat unit.

8 Claims, 12 Drawing Sheets

MODULAR CHAIR CONSTRUCTION

BACKGROUND OF THE INVENTION

1. Field of the Invention

This invention relates to a chair, which includes a seat, a back and two armrests, more particularly to a modular chair construction, in which the back and the armrests are mounted removably on the seat.

2. Description of the Related Art

Referring to FIG. 1, a conventional sofa 1 is shown to include a seat unit 10, two armrest units 11, and a back unit 12. Each of the seat unit 10, the armrest units 11, and the back unit 12 consists of a main body 100, 110, 120, and a covering 14 that is attached fixedly to the main body 100, 110, 120. Because the armrest units 11 and the back unit 12 are fixed on the seat unit 10 by means of bolts 15, it is difficult to transport the sofa 1. Furthermore, when any of the seat 10, the armrests 11, and the back 12 is damaged, it cannot be replaced with a new one. As a result, the entire sofa 1 is thrown away.

SUMMARY OF THE INVENTION

The object of this invention is to provide a modular sofa or chair, in which the parts can be easily disassembled for replacement and transport.

According to this invention, a modular chair includes a seat unit, a back unit that is mounted removably on the seat unit, and two armrest units that are mounted respectively and removably on the left and right sides of the seat unit.

BRIEF DESCRIPTION OF THE DRAWINGS

These and other features and advantages of the invention will become apparent in the following detailed description of the preferred embodiments, with reference to the accompanying drawings, in which.

DETAILED DESCRIPTION OF THE PREFERRED EMBODIMENTS

Figure 1:
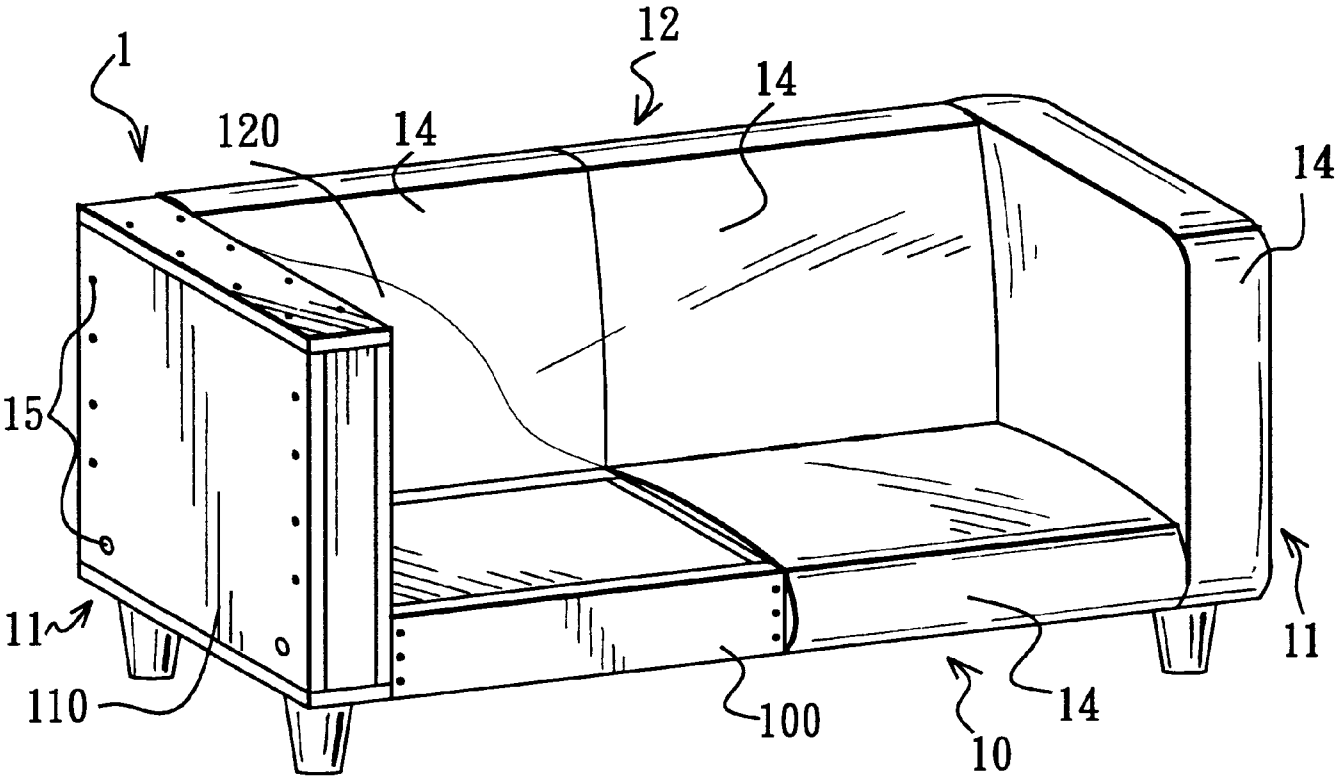
FIG. 1 PRIOR ART
FIG. 1 is a perspective view of a conventional sofa.
Figure 2:
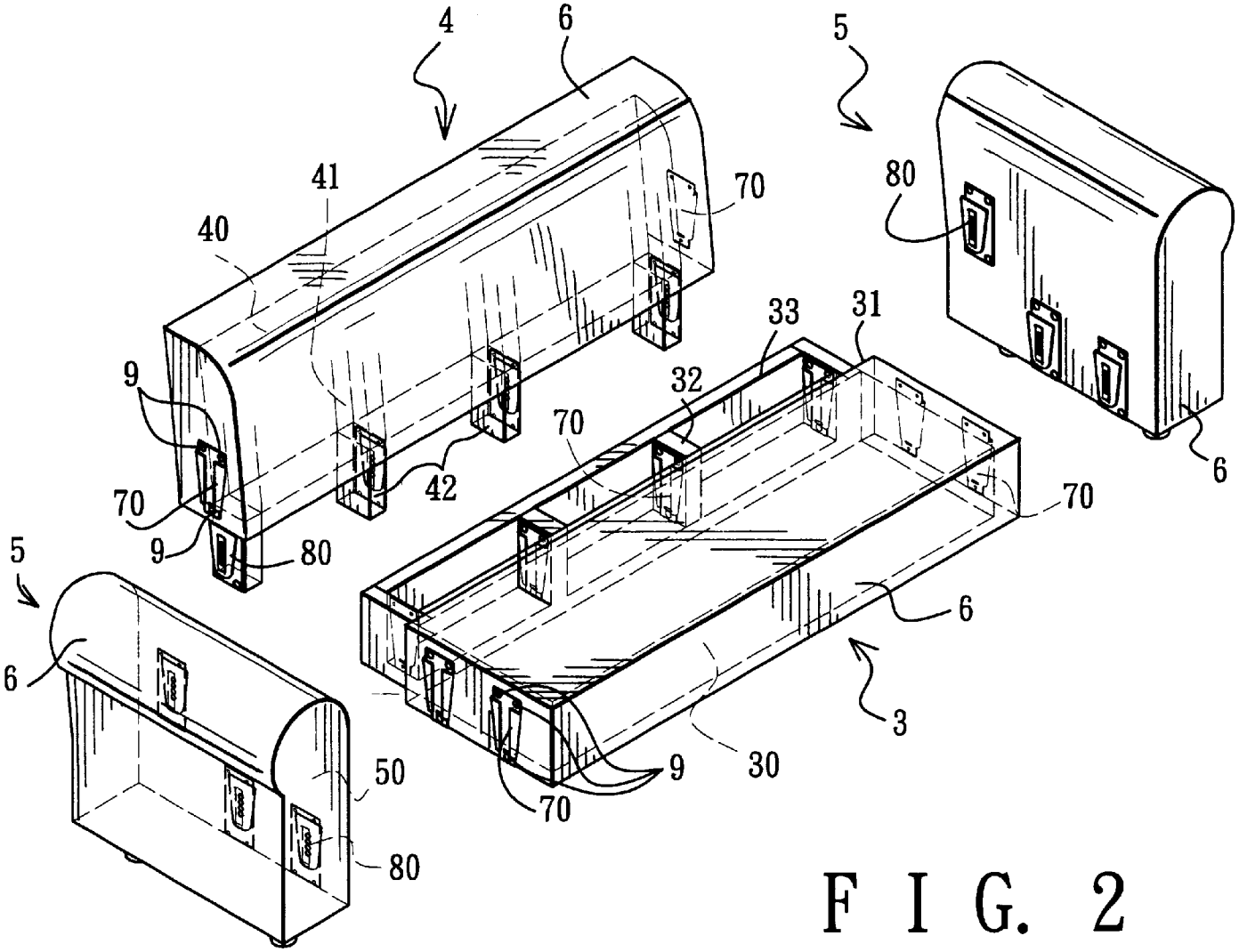
FIG. 2 is an exploded perspective view of a first preferred embodiment of a modular chair of this invention.
Figure 3:
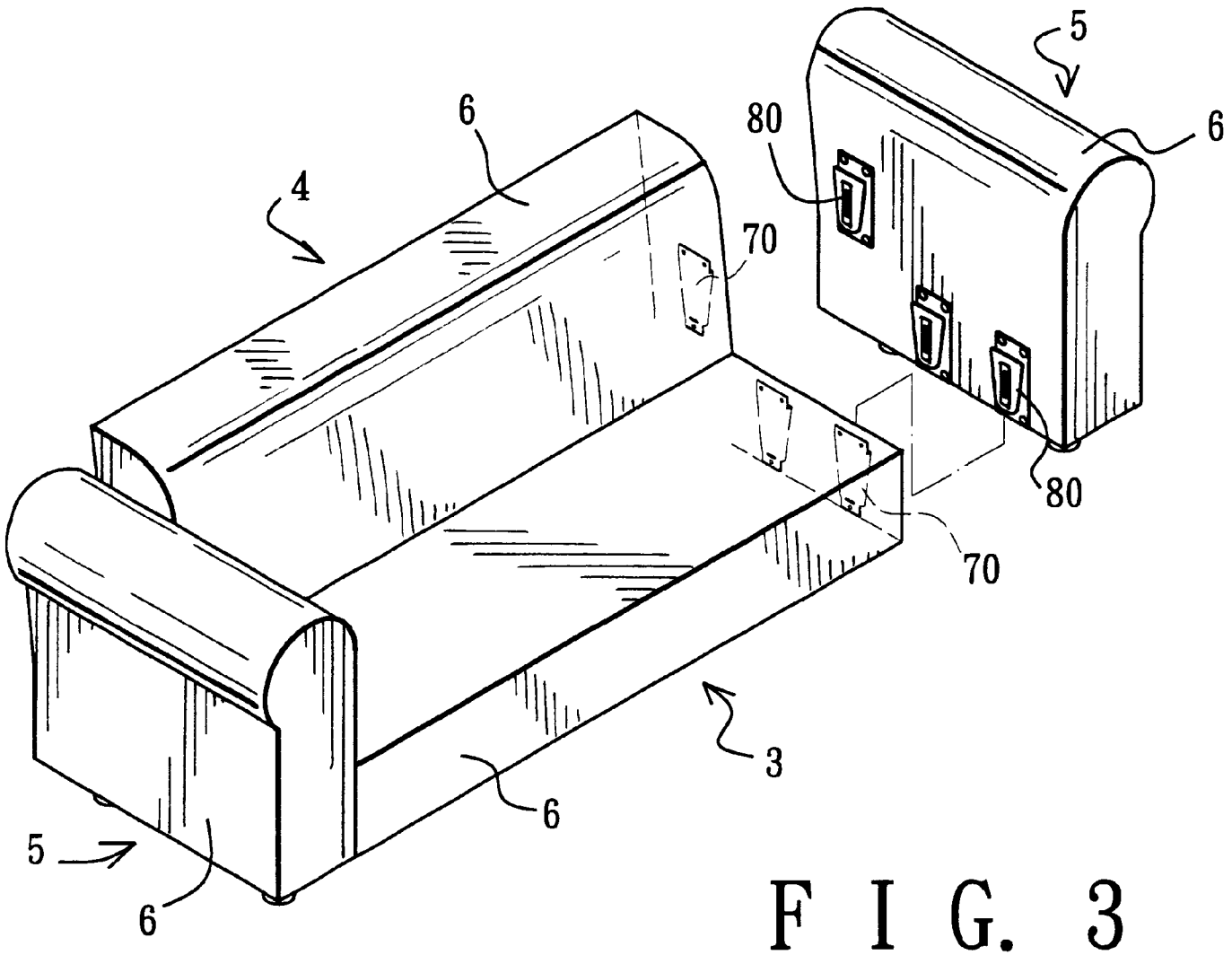
FIG. 3 is a partly exploded perspective view of the first preferred embodiment.

Referring to FIGS. 2 and 3, a first preferred embodiment of a modular sofa of the invention is shown to include a seat unit 3, a back unit 4, and two armrest units 5. Each of the seat unit 3, the back unit 4, and the armrest units 5 includes a main body 30, 40, 50, and a covering 6 that surrounds the main body 30, 40, 50. A retainer assembly includes a plurality of first retainers 70 and a plurality of second retainers 80 for mounting the back unit 4 removably on the rear side 31 of the seat unit 3, and for mounting the armrest units 5 respectively and removably on the left and right sides of the seat unit 3. Each of the first and second retainers 70, 80 is made of metal. Four first vertical plates 32 and a U-shaped frame 33 are connected fixedly to the seat unit 3. The back unit 4 further includes four fixed supporting posts 41, each of which has a lower end that is provided with a fixed second vertical plate 42.

The first retainers 70 are fastened to the left and right sides of the seat unit 3, the left and right sides of the back unit 4, and the first vertical plates 32 by means of first bolts 9. The second retainers 80 are fastened to the back unit 4, the armrest units 5, and the second vertical plates 42 by means of second bolts 9. Each of the first and second bolts 9 extends in a direction that is parallel to the rear side 31 of the seat unit 3, thereby preventing removal of the first and second retainers 70, 80 from the seat unit 3, the back unit 4, and the armrest units 5 when a rearward force is applied to the back unit 4. The positions of the first retainers 70 can be exchanged for those of the second retainers 80.

Figure 4:
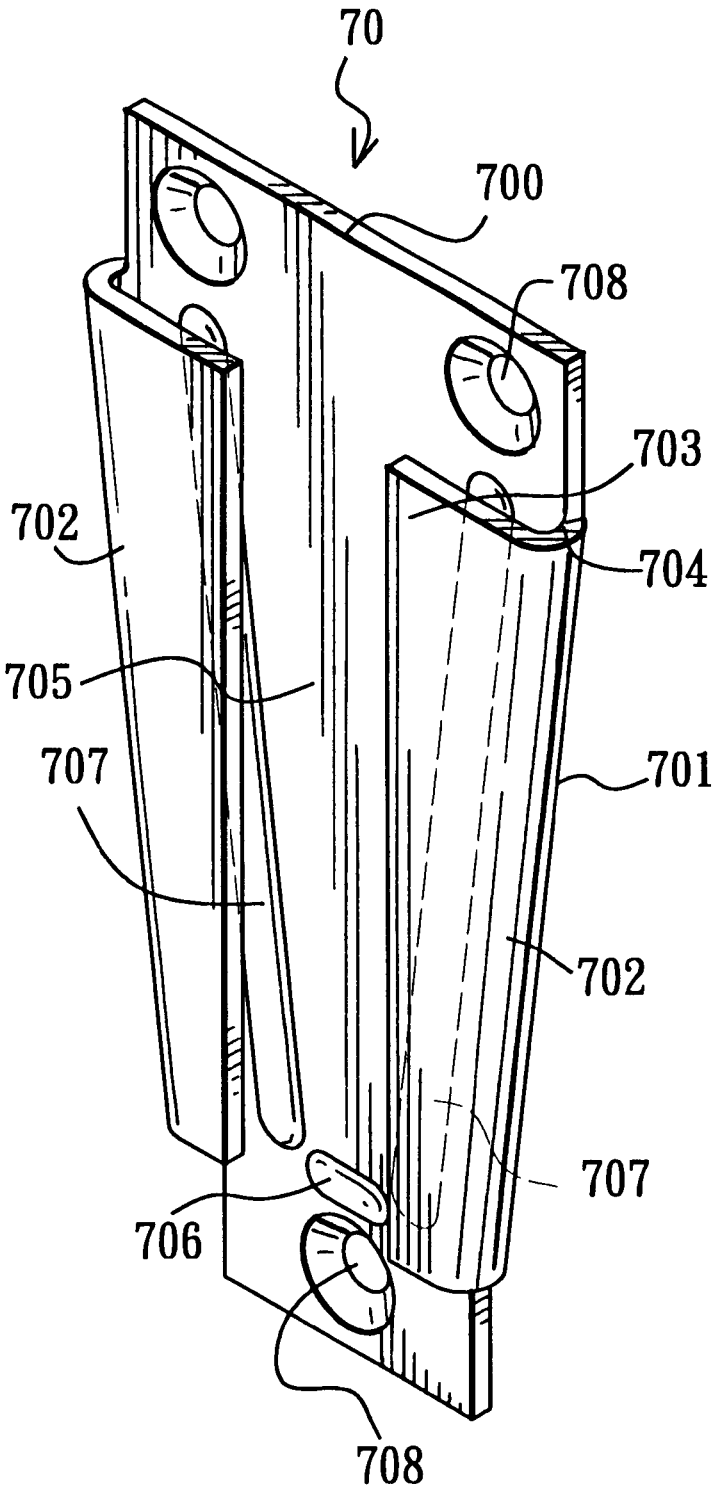
FIG. 4 is a perspective view of a first retainer of the first preferred embodiment.

Referring to FIG. 4, each of the first retainers 70 is shown to include a vertical first mounting plate 700 with two opposite side edges 701 that incline downwardly and inwardly, and two L-cross-sectioned flanges 702 that project respectively and integrally from the side edges 701 of the first mounting plate 700 and that are spaced apart from each other. Each of the flanges 702 has a vertical plate portion 703 that is parallel to and that is spaced apart from the first mounting plate 700, and a connecting portion 704 that interconnects the vertical plate portion 703 and the first mounting plate 700, thereby defining a dovetail groove unit 705 among the first mounting plate 700 and the flanges 702. The first mounting plate 700 is formed from a metal plate, which is pressed to form a projection 706 that is adjacent to the lower ends of the flanges 702, and two inclined reinforcing ribs 707 that are aligned respectively with the flanges 702. Three holes 708 are formed through the first mounting plate 700 for extension of the first bolts 9 (see FIG. 2) therethrough.

Figure 5:
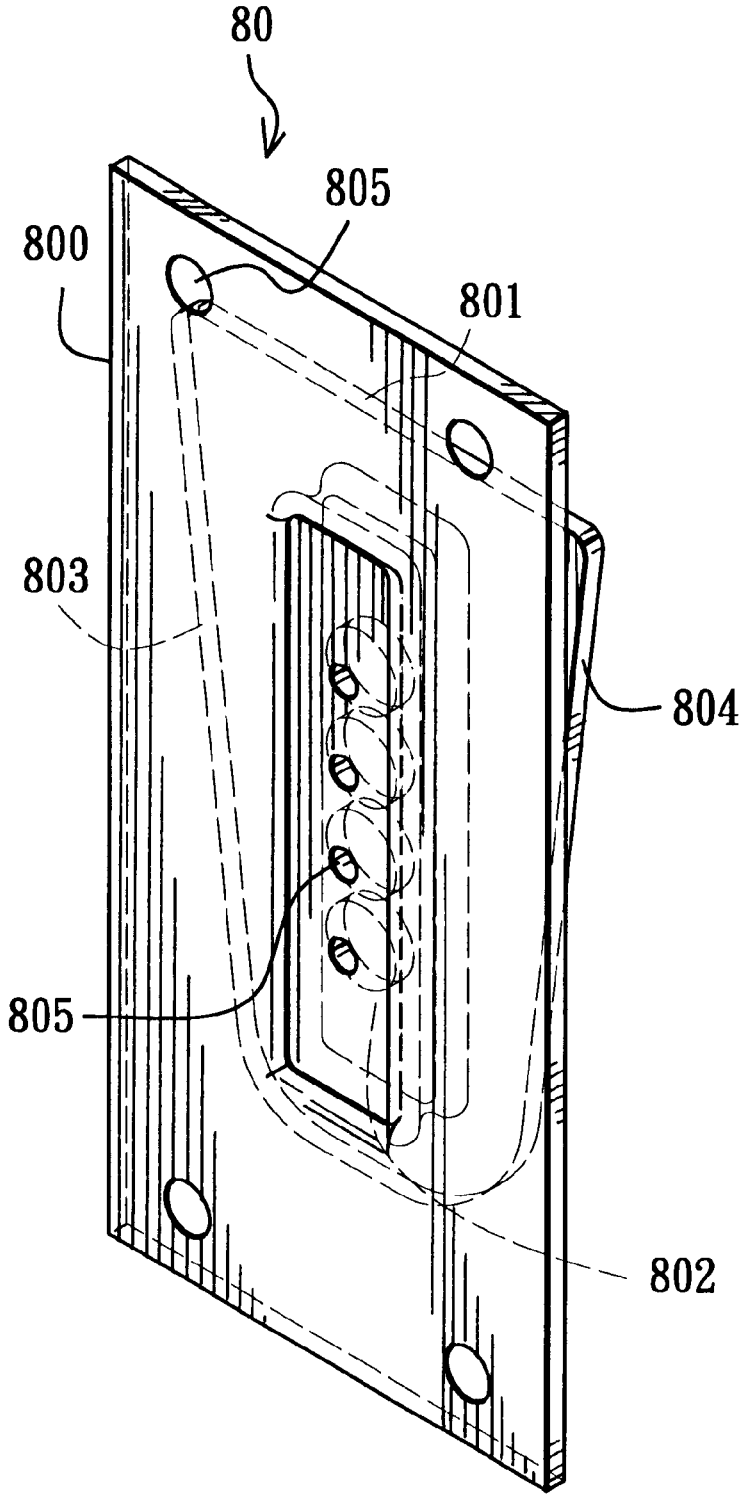
FIG. 5 is a perspective view of a second retainer of the first preferred embodiment.

Referring to FIGS. 4 and 5, each of the second retainers 80 is shown to include a vertical second mounting plate 800, a tapered vertical insert plate 801, and a connecting strip 802. The second mounting plate 800 is disposed parallel to the first mounting plates 700. The insert plate 801 is disposed between the first mounting plate 700 and the flanges 702 of a corresponding one of the first retainers 70, and has two downwardly and inwardly inclined opposite sides 803, 804, each of which is disposed between the first mounting plate 700 and a corresponding one of the flanges 702. The connecting strip 802 interconnects integrally the second mounting plate 800 and the insert plate 801, and extends between the flanges 702. As such, the insert plate 801 and the connecting strip 802 constitute a dovetail tongue unit, which engages the dovetail groove unit 705 that is defined between the first mounting plate 700 and the flanges 702. Because the insert plate 801 has a width that increases upwardly and gradually, it can be inserted easily into the dovetail groove unit 705. The lower end of the insert plate 801 rests on the projection 706, which acts as a stop unit, for preventing downward removal of the second retainer 80 from the first retainer 70. The second mounting plate 800 has a plurality of holes 805 for extension of the second bolts 9 (see FIG. 2) therethrough.

Figure 6:
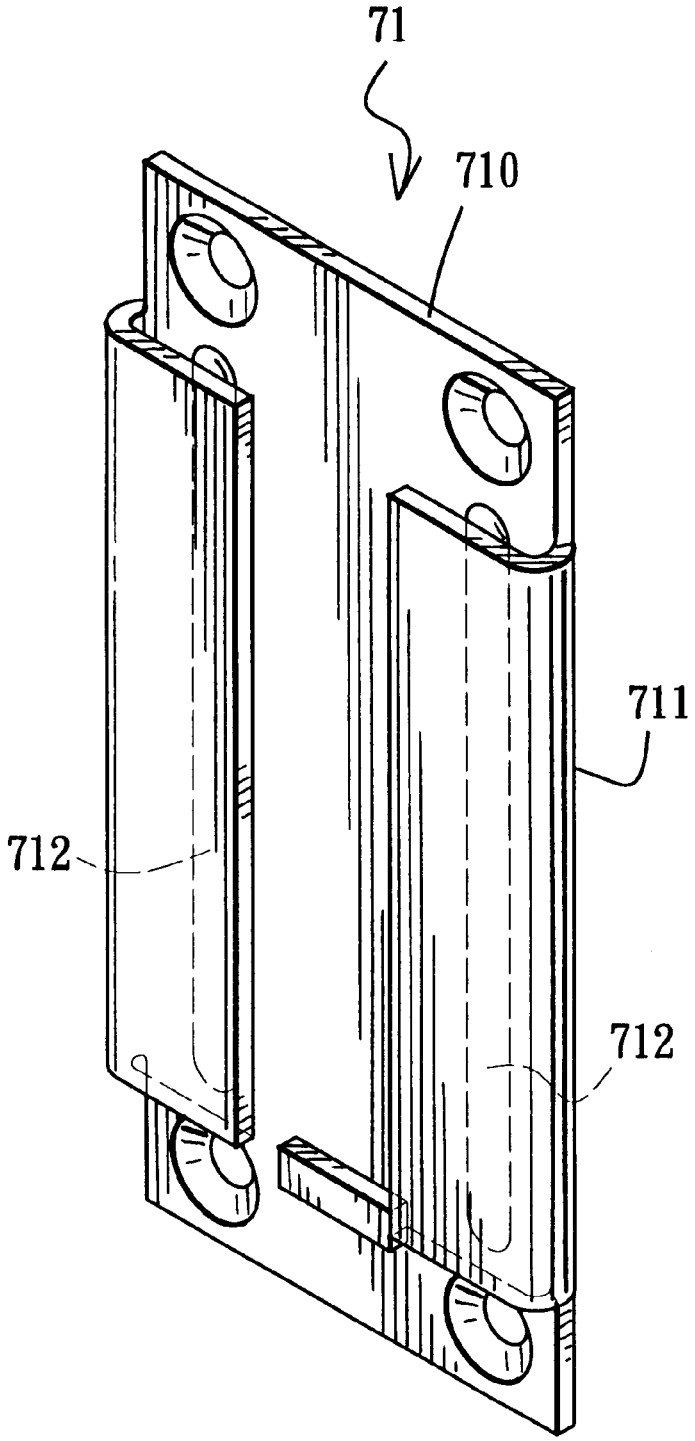
FIG. 6 is a perspective view of a first retainer of a second preferred embodiment of this invention.

FIG. 6 illustrates a first retainer 71 of a second preferred embodiment. Unlike the first embodiment, two opposite side edges 711 of a first mounting plate 710 and two reinforcing ribs 712 are vertical.

Figure 7:
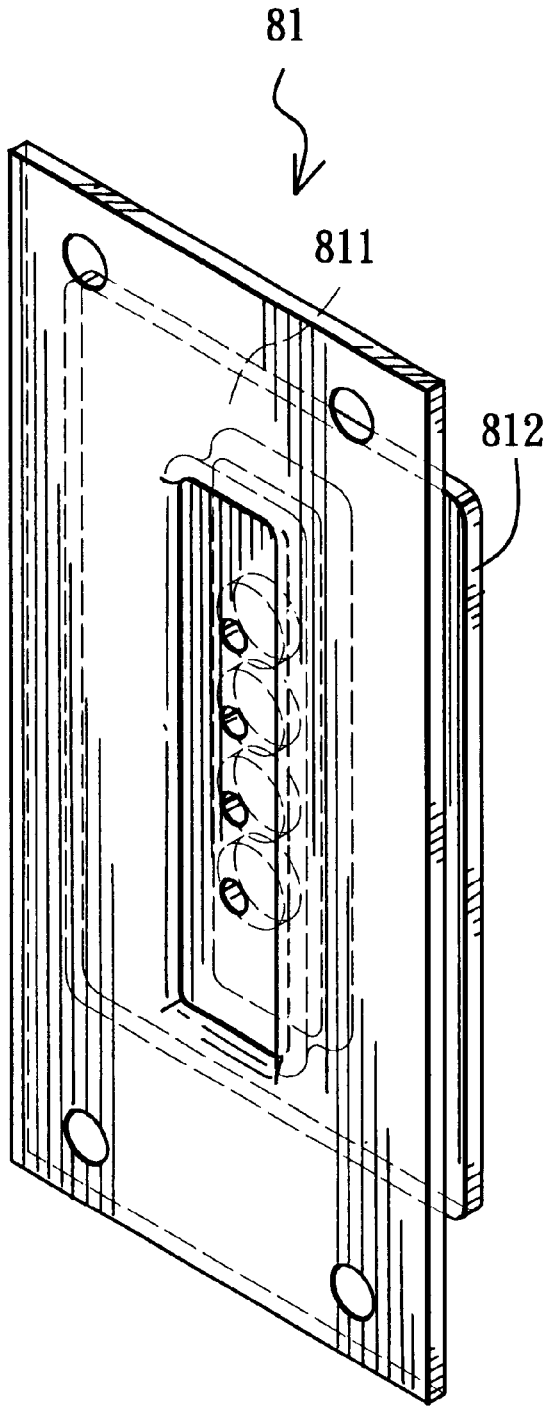
FIG. 7 is a perspective view of a second retainer of the second preferred embodiment.

FIG. 7 illustrates a second retainer 81 of the second preferred embodiment, which includes an insert plate 811. Unlike the first embodiment, the insert plate 811 has two vertical sides 812.

Figure 8:
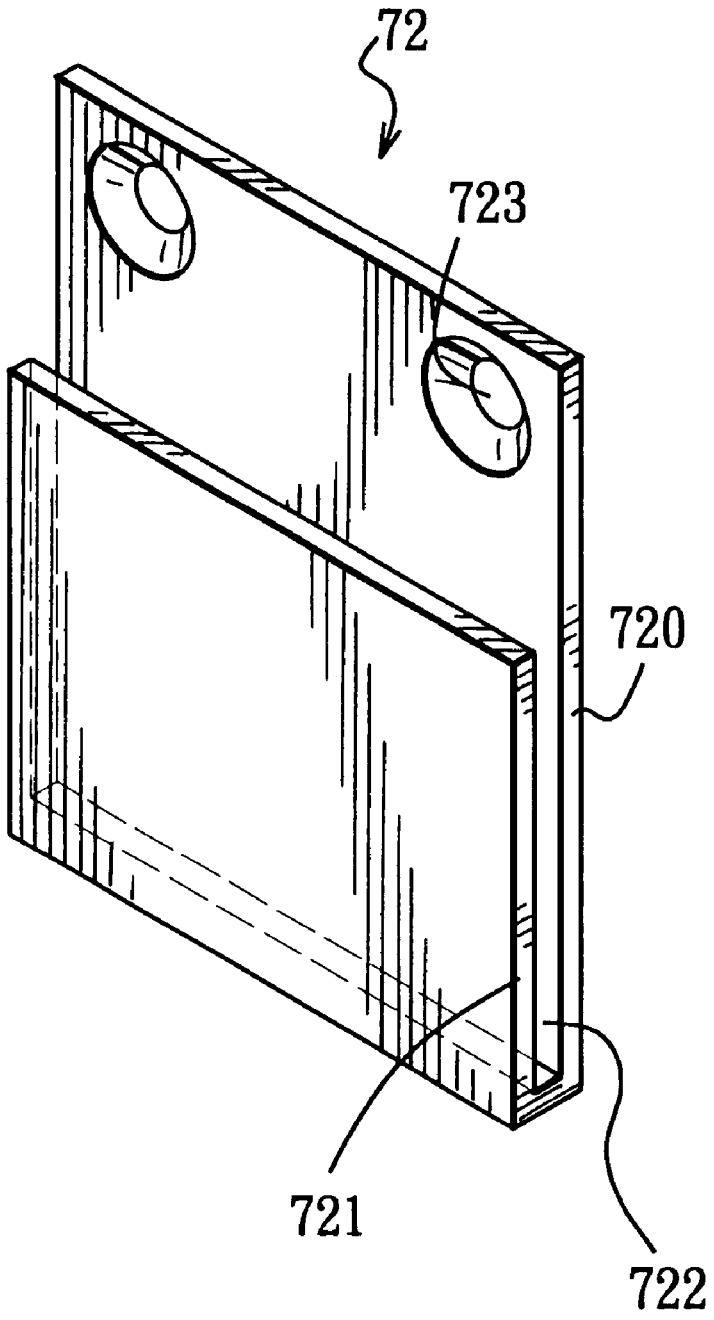
FIG. 8 is a perspective view of a first retainer of a third preferred embodiment of this invention.
Figure 9:
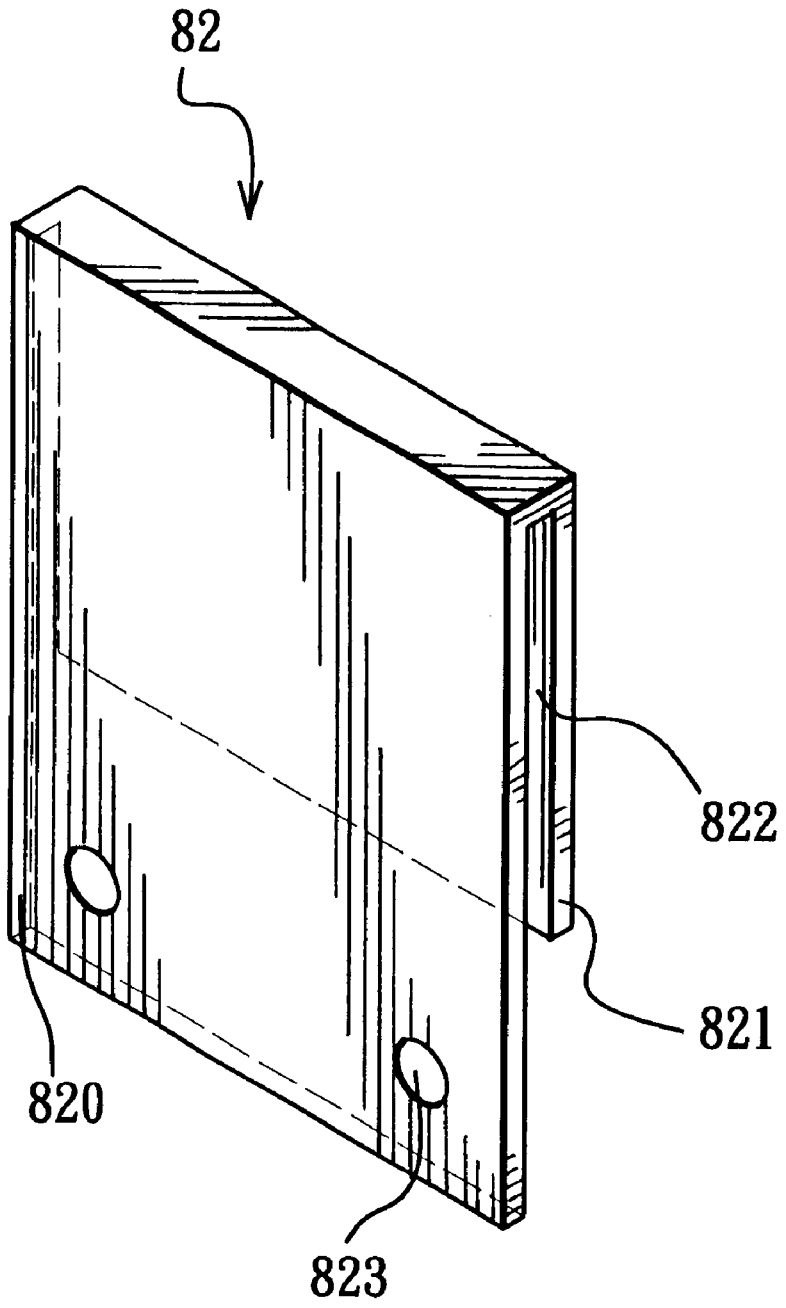
FIG. 9 is a perspective view of a second retainer of the third preferred embodiment.

FIGS. 8 and 9 illustrate respectively a first retainer 72 and a second retainer 82 of a third preferred embodiment. The first retainer 72 includes a vertical first mounting plate 720 and a vertical first insert plate 721 that is disposed parallel to the first mounting plate 720 and that is formed integrally with the lower end of the first mounting plate 720 at the lower end thereof. The second retainer 82 includes a vertical second mounting plate 820 and a vertical second insert plate 821, which is inserted into a space 722 between the first mounting plate 720 and the first insert plate 721 and which has an upper end that is formed integrally with the upper end of the second mounting plate 820. The first insert plate 721 is inserted into a space 822 between the second mounting plate 820 and the second insert plate 821. Each of the first and second mounting plates 720, 820 has two holes 723, 823, which are formed therethrough for extension of the first and second bolts 9 (see FIG. 2).

Figure 10:
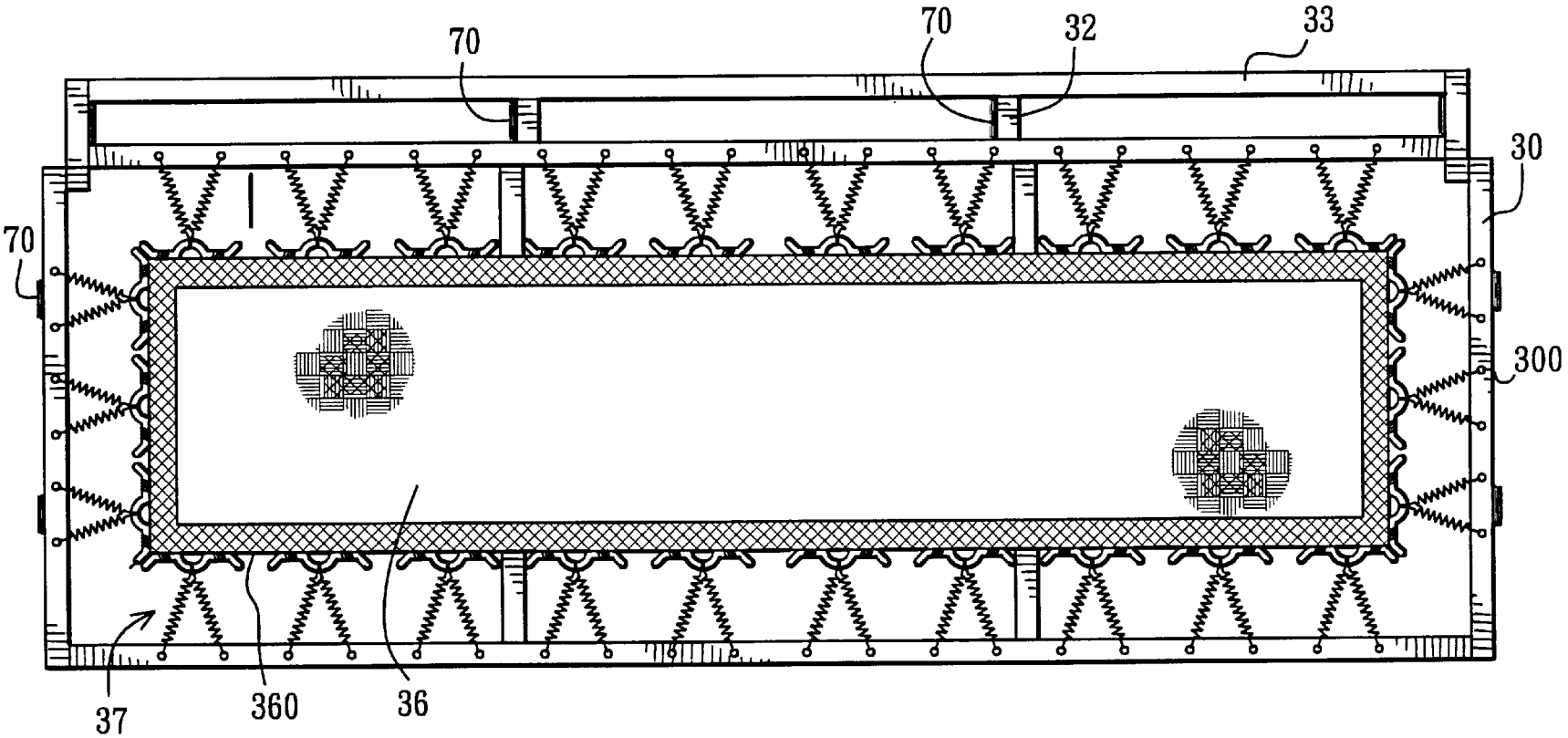
FIG. 10 is a schematic top view illustrating a seat unit of the first preferred embodiment.
Figure 11:
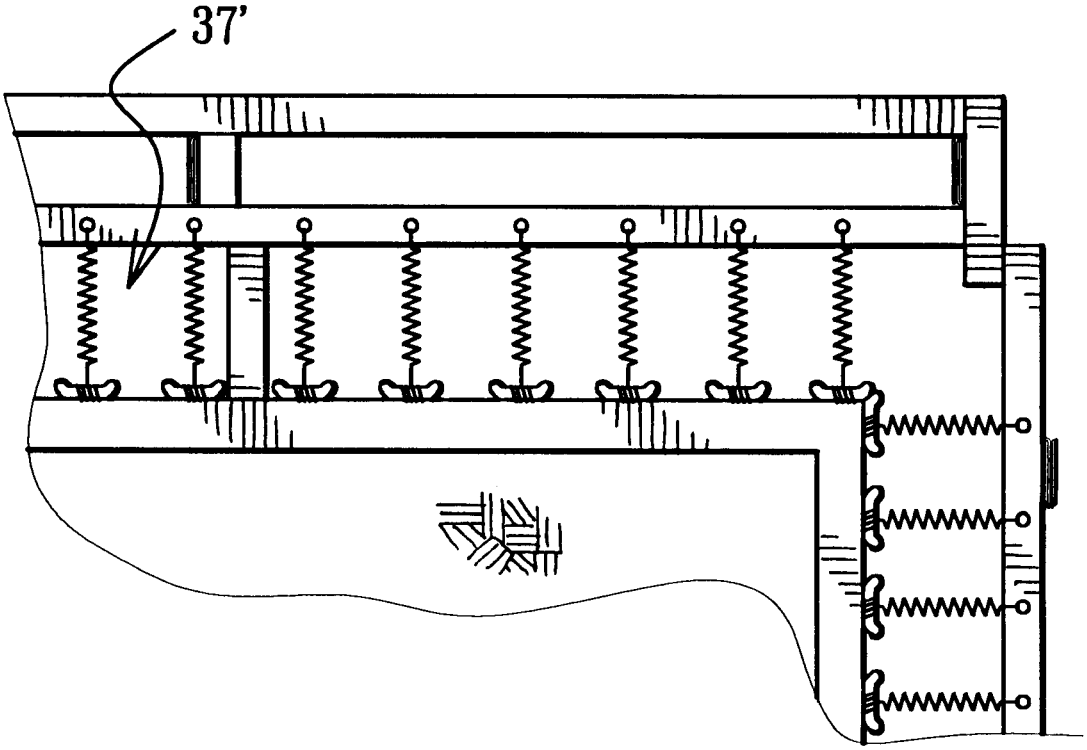
FIG. 11 is a schematic top view illustrating a modified seat unit of the invention.

Referring to FIG. 10, the seat unit 3 of the first embodiment includes an annular peripheral frame 30, a seat cushion member 36, and a plurality of coiled springs 37, which are interposed between the frame 30 and an outer periphery 360 of the seat cushion member 36. As illustrated, the springs 37 are arranged along total length of the outer periphery 360 of the seat cushion member 36. Each of the springs 37 is V-shaped, and has two end portions that are secured within two holes 300 in the frame 30, and an intermediate portion that is attached to the seat cushion member 36 so as to connect the seat cushion member 36 to an adjacent portion of the frame 30, thereby maintaining the seat cushion member 36 at a predetermined level. The shape of the springs 37 can be modified. For example, as shown in FIG. 11, the springs 37' may be straight.

Figure 12:
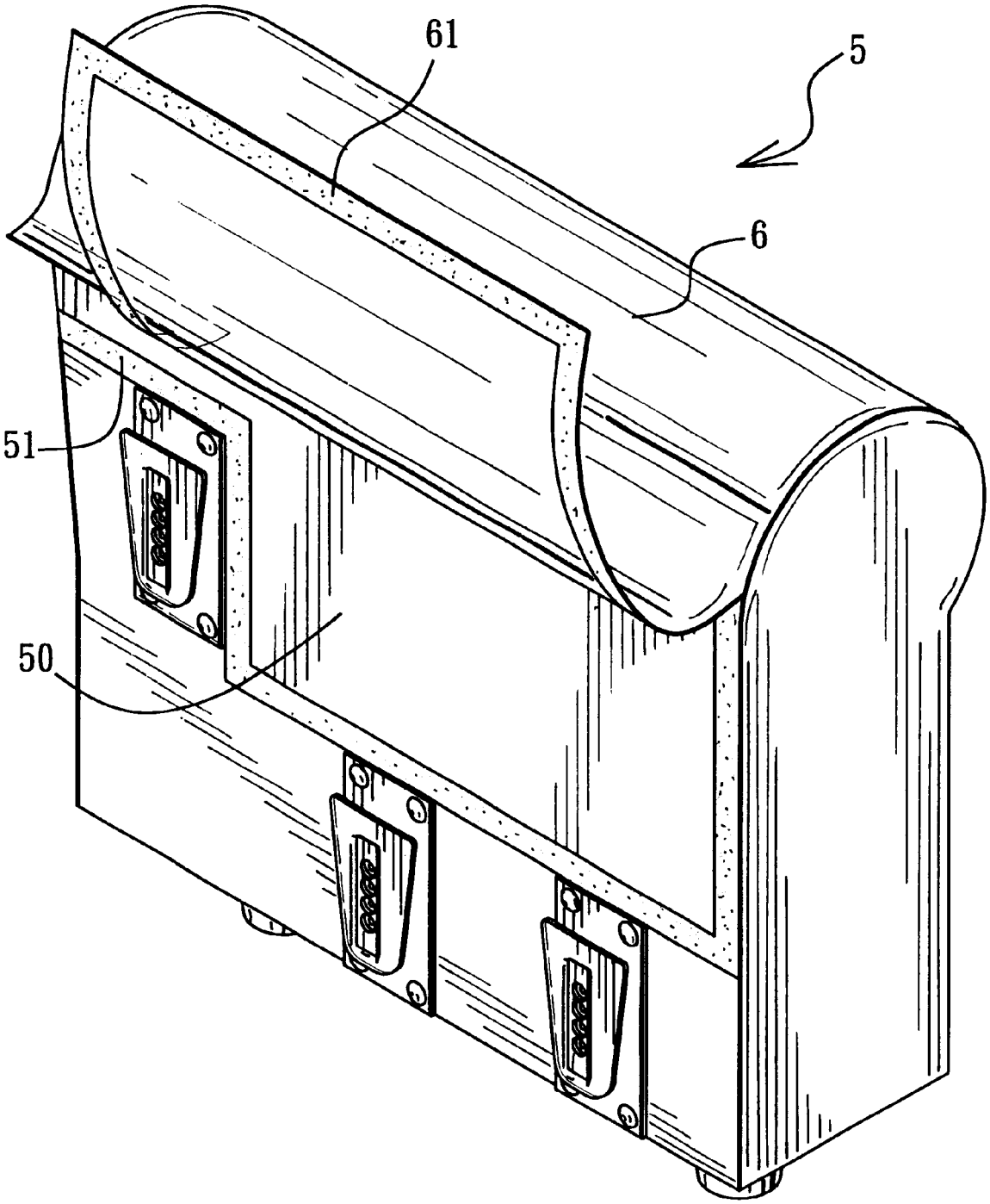
FIG. 12 is a perspective view illustrating how a covering is provided on a main body of an armrest unit of the first preferred embodiment.

Referring to FIG. 12, each of the main bodies 50 of the armrest units 5 is provided with a first hook-and-loop tape 51. Each of the coverings 6 is provided with a second hook-and-loop tape 61 that engages the first hook-and-loop tape 51 for preventing removal of the coverings 6 from the main bodies 50. The remaining coverings 6 are attached to the main bodies 30, 40 (see FIG. 2) in a similar way.

With this invention thus explained, it is apparent that numerous modifications and variations can be made without departing from the spirit and scope of this invention. It is therefore intended that this invention be limited only as indicated by the appended claims.

I claim:

1. A modular chair with a seat unit, a back unit, and two armrest units, said seat unit having a rear side, a left side, and a right side, and further comprising a retainer assembly, which mounts said back unit removably on said rear side of said seat unit and which mounts said armrest units respectively and removably on said left and right sides of said seat unit and said retainer assembly includes:

a plurality of first retainers;

a plurality of second retainers that are connected respectively and removably to said first retainers;

a plurality of first bolts fastening respectively said first retainers to one of said seat unit and said back unit; and a plurality of second bolts fastening respectively said second retainers to the other one of said seat unit and said back unit, said first and second bolts extending in a direction that is parallel to said rear side of said seat unit, thereby preventing removal of said first and second retainers from said seat unit and said back unit when a rearward force is applied to said back unit.

2. A modular chair as claimed in claim 1, wherein said seat unit includes a plurality of first vertical plates that are connected fixedly to said rear side of said seat unit, said first retainers being fastened respectively to said first vertical plates by means of said first bolts, said back unit including a plurality of second vertical plates that are connected fixedly to a lower end thereof, said second retainers being fastened respectively to said second vertical plates by means of said second bolts.

3. A modular chair as claimed in claim 1, wherein each of said first retainers includes:

a vertical first mounting plate fastened to said one of said seat unit and said back unit by means of a respective one of said first bolts and having two opposite side edges;

two L-cross-sectioned flanges projecting respectively and integrally from said side edges of said first mounting plate and spaced apart from each other, each of said flanges having a vertical plate portion that is parallel to and that is spaced apart from said first mounting plate, and a connecting portion that interconnects said vertical plate portion and said first mounting plate, thereby defining a dovetail groove unit among said first mounting plate and said flanges; and a stop unit provided on said first mounting plate;

each of said second retainers including:

a vertical second mounting plate disposed parallel to said first mounting plates and fastened to the other one of said seat unit and said back unit by means of a respective one of said second bolts;

a vertical insert plate disposed between said first mounting plate and said flanges of a corresponding one of said first retainers; and a connecting strip interconnecting integrally said insert plate and said second mounting plate and extending between said flanges of said corresponding one of said first retainers so that said insert plate and said strip constitute a dovetail tongue unit, which engages said dovetail groove unit that is defined between said first mounting plate and said flanges of said corresponding one of said first retainers, each of said insert plates having a lower end that rests on said stop unit of a corresponding one of said first retainers, thereby preventing downward removal of said second retainers from said first retainers.

4. A modular chair as claimed in claim 3, wherein said two opposite side edges of each of said first mounting plates incline downwardly and inwardly, each of said insert plates being tapered and having two downwardly and inwardly inclined opposite sides, each of which is disposed between said first mounting plate and a corresponding one of said flanges of a corresponding one of said first retainers.

5. A modular chair as claimed in claim 3, wherein said two opposite side edges of each of said first retainers are vertical, each of said insert plates having two vertical sides, each of which is disposed between said first mounting plate and a corresponding one of said flanges of a corresponding one of said first retainers.

6. A modular chair as claimed in claim 3, wherein each of said first mounting plates is formed from a metal plate, which is pressed to form a projection that constitutes said stop unit.

7. A modular chair as claimed in claim 3, wherein each of said first mounting plates is formed from a metal plate, which is pressed to form two reinforcing ribs that are aligned respectively with said flanges of a corresponding one of said first retainers.

8. A modular chair as claimed in claim 1, wherein each of said first retainers includes:

a vertical first mounting plate fastened to said one of said seat unit and said back unit by means of a corresponding one of said first bolts; and a vertical first insert plate disposed parallel to and spaced apart from said first mounting plate, said first insert plate having a lower end, which is formed integrally with a lower end of said first mounting plate;

each of said second retainers including:

a vertical second mounting plate fastened to the other one of said seat unit and said back unit by means of a corresponding one of said second bolts; and a vertical second insert plate disposed parallel to and spaced apart from said second mounting plate, said second insert plate being formed integrally with an upper end of said second mounting plate at an upper end thereof and being inserted into a space between said first mounting plate and said first insert plate of a corresponding one of said first retainers, each of said first insert plates being inserted into a space between said second mounting plate and said second insert plate of a corresponding one of said second retainers.

* * * * *